US008107838B2

(12) United States Patent
Dorfner

(10) Patent No.: US 8,107,838 B2
(45) Date of Patent: Jan. 31, 2012

(54) METHOD AND DEVICE FOR PROCESSING A MEASUREMENT SIGNAL FOR DETECTING A PROPERTY OF A TONER MARK

(75) Inventor: Ralph Dorfner, Oberding (DE)

(73) Assignee: Océ Printing Systems GmbH, Poing (DE)

( * ) Notice: Subject to any disclaimer, the term of this patent is extended or adjusted under 35 U.S.C. 154(b) by 300 days.

(21) Appl. No.: 12/518,768

(22) PCT Filed: Dec. 12, 2007

(86) PCT No.: PCT/EP2007/063805

§ 371 (c)(1),
(2), (4) Date: Jun. 11, 2009

(87) PCT Pub. No.: WO2008/071740

PCT Pub. Date: Jun. 19, 2008

(65) Prior Publication Data

US 2010/0028027 A1 Feb. 4, 2010

(30) Foreign Application Priority Data

Dec. 12, 2006 (DE) ..... 10 2006 058 579

(51) Int. Cl.
*G03G 15/00* (2006.01)

(52) U.S. Cl. ..... 399/49

(58) Field of Classification Search ..... 399/27, 399/29, 49, 60, 72, 53
See application file for complete search history.

(56) References Cited

U.S. PATENT DOCUMENTS 4,341,461 A * 7/1982 Fantozzi ..... 399/49
5,481,337 A 1/1996 Tsuchiya et al.
5,574,544 A 11/1996 Yoshino et al.
(Continued)

FOREIGN PATENT DOCUMENTS

DE 199 00 164 A1 7/2000
(Continued)

*Primary Examiner* — Susan Lee
(74) *Attorney, Agent, or Firm* — Schiff Hardin LLP

(57) ABSTRACT

In a method or system for processing a measurement signal for detecting a property of a toner mark, the toner mark is produced and detected. A measurement signal is output, a signal curve of the measurement signal being determined. A temporal measurement window is provided for detecting a property of the toner mark, the temporal measurement window having a beginning and an end. A plausibility check is carried out of the determined signal curve wherein a maximum value and a minimum value of the signal curve are determined, a first difference value between a maximum value and the minimum value is determined, a first temporal distance is determined between an occurrence of the maximum value and an occurrence of the minimum value, a second temporal distance is determined between at least one of the beginning and end of the measurement window and the occurrence of at least one of the maximum value and the minimum value, and a second difference value is determined between a first distance of the maximum value from a reference value and a second distance of the minimum value from the reference value, and the second determined difference value is compared to at least one of a defined minimum difference value and a defined maximum difference value.

7 Claims, 7 Drawing Sheets

U.S. PATENT DOCUMENTS

| | | | | |
|---|---|---|---|---|
| 6,498,909 | B1 | 12/2002 | Reihl | |
| 6,771,913 | B2 | 8/2004 | Jeschonek et al. | |
| 7,016,620 | B2 | 3/2006 | Maess et al. | |
| 2003/0081214 | A1 | 5/2003 | Mestha et al. | |
| 2003/0091355 | A1 | 5/2003 | Jeschonek et al. | |
| 2003/0231350 | A1 | 12/2003 | Yamagishi | |
| 2004/0253013 | A1 | 12/2004 | Furukawa | |
| 2008/0050133 | A1 * | 2/2008 | Adiletta | 399/49 |

FOREIGN PATENT DOCUMENTS

| | | | |
|---|---|---|---|
| DE | 101 36 259 | A1 | 2/2003 |
| DE | 101 51 703 | A1 | 5/2003 |
| DE | 103 04 884 | B3 | 9/2004 |
| JP | 2004-341232 | A | 12/2004 |
| WO | WO 99/36834 | | 7/1999 |

* cited by examiner

METHOD AND DEVICE FOR PROCESSING A MEASUREMENT SIGNAL FOR DETECTING A PROPERTY OF A TONER MARK

BACKGROUND

The present preferred embodiment relates to a method and a device for processing a measurement signal for detecting a property of a toner mark, in which a signal curve of a measurement signal is determined.

In electrographic high-speed printers for printing individual sheets or web-type carrier material at print speeds of >50 DIN A4 sheets per minute up to several hundred DIN A4 sheets per minute, as well as print and image production speeds of, currently, up to 2 meters per second, large quantities of toner material may be consumed within a relatively short time in order to produce the print images. In such electrographic high-speed printers, inking control devices are used in order to keep the degree of inking of print images constant. Electrographic image production methods include for example electrographic, magnetographic, and ionographic image production methods.

From document DE 101 36 259 A1, and the parallel U.S. Pat. No. 7,016,620 B2, a method and a device are known for controlling a print process in which a character generator produces a toner mark on an intermediate carrier with energy lower than that used to produce other print images, so that the color density of the inked toner mark is reduced. A reflection sensor determines the color density of the inked toner mark, and in a developer station the toner concentration is set as a function of the determined color density.

In addition, from document DE 101 51 703 A1, and the parallel U.S. Pat. No. 6,771,913 B2, measurement arrangements are known for determining the layer thickness of a toner mark using capacitive sensors. The named documents are hereby incorporated into the present description by reference.

A false detection, in particular a false measurement value, of a property of the toner mark used for the regulation of the electrographic image production process would result immediately in incorrect settings of the parameters of the image production process, and would in particular cause an incorrect inking of the print image to be produced. Such a false detection of the property of the toner mark can in particular cause an incorrect inking of the print image to be produced. Such a false detection of the property of the toner mark can in particular be caused by disturbances, damage, or contamination of an intermediate image carrier, in particular a photoconductor or a transfer band.

From each of the documents JP 2004-341232 A, US 2004/0253013 A, U.S. Pat. No. 5,574,544 A, US 2003/0081214 A, U.S. Pat. No. 5,481,337 A, and US 2003/231350 A, arrangements and methods are known for detecting a toner mark, by which an image production process is controlled.

SUMMARY

An object is to indicate a method and a device for processing a measurement signal for detecting a property of a toner mark by which it is ensured that at least no strongly falsified measurement signals are used for the controlling or regulation of the image production process.

In a method or system for processing a measurement signal for detecting a property of a toner mark, the toner mark is produced and detected. A measurement signal is output, a signal curve of the measurement signal being determined. A temporal measurement window is provided for detecting a property of the toner mark, the temporal measurement window having a beginning and an end. A plausibility check is carried out of the determined signal curve wherein a maximum value and a minimum value of the signal curve are determined, a first difference value between a maximum value and the minimum value is determined, a first temporal distance is determined between an occurrence of the maximum value and an occurrence of the minimum value, a second temporal distance is determined between at least one of the beginning and end of the measurement window and the occurrence of at least one of the maximum value and the minimum value, and a second difference value is determined between a first distance of the maximum value from a reference value and a second distance of the minimum value from the reference value, and the second determined difference value is compared to at least one of a defined minimum difference value and a defined maximum difference value.

DESCRIPTION OF THE PREFERRED EMBODIMENTS

Figure 1A:
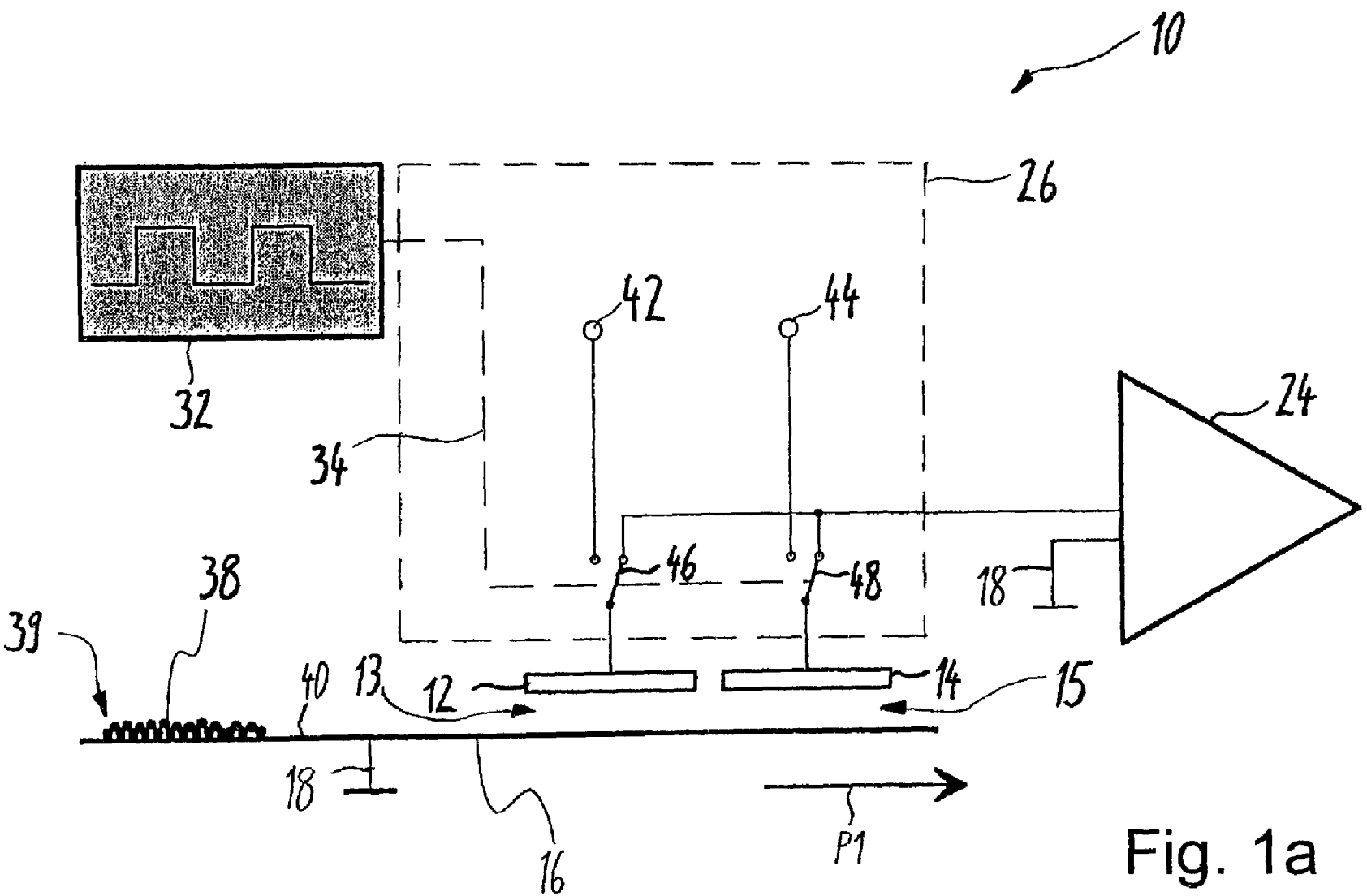
FIG. 1*a* shows a schematic representation of the design of a device for determining the surface coverage of a toner mark.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

Using a method for processing a measurement signal for detecting a property of a toner mark, a plausibility check is carried out of the determined signal curve of the measurement signal. In this way, it can be determined whether the measurement signal produced by the toner mark sensor has a signal curve that is characteristic for the produced toner mark. On the basis of a maximum-minimum analysis, an evaluation unit of the toner mark sensor can produce a control signal that can be used to control the inking of the image production process. By carrying out the plausibility check, it can easily be avoided that measurement results that deviate strongly from the actual measurement result are used to control the image production process, which could worsen print quality and could permanently damage components involved in the image production process. This is possible for example if too much toner is conveyed into a developer station, whereby the two-component mixture of toner particles and carrier particles present there can be permanently damaged by the significantly excessive quantity of toner requested, and whereby in particular a triboelectric charging of the toner particles can no longer take place to an adequate extent.

Via the plausibility check of the sensor signal outputted directly by a sensor for detecting the property of the toner mark, and/or of the signal curve thereof, errored measurement values can be quickly and directly recognized without these values having already been modified or adapted by further processing. Such a plausibility check can determine both mechanical damage and also contamination of an image carrier in the area in which the toner mark is produced. This area is also called the marker trace. The contamination can be caused by toner adhering to the image carrier that was not previously removed from the image carrier by a cleaning unit.

In a development of the method, a maximum value and a minimum value of the signal curve are determined. These extreme values (maximum value, minimum value) are preferably determined in a measurement window by which a time period is defined in which the toner mark to be analyzed is detected by a measurement arrangement, in particular a capacitive toner mark sensor. In addition, a difference value between the maximum value and the minimum value can be determined and outputted for further processing. Using the plausibility check, the plausibility is then checked of the maximum value, the minimum value, and/or the difference value. Using the difference value, in particular the layer thickness can easily be determined of a toner layer that is supplied to a capacitive sensor. It is also possible for example to determine the average inking of a toner mark not inked over its entire surface with toner particles, whereby, given a known layer thickness of the inked areas, the inked surface can then be inferred. This inked surface can be used as an actual value for a point size controlling or line width controlling. The measurement signal is preferably scanned using a sensor arrangement. Here, the signal curve can be produced from a plurality of successively determined scanned values of the measurement signal output by the sensor arrangement.

Using the plausibility check, it can be checked whether the determined measurement value curve, the determined maximum value, the determined minimum value, and/or the difference value are characteristic for the produced toner mark. For the plausibility check, in particular the temporal distance between the occurrence of the maximum value and the occurrence of the minimum value can be determined as a criterion. Furthermore, alternatively or in addition to the plausibility check, the temporal distance between a measurement window quantity of the temporal measurement window for the detection of the property of the toner mark and the occurrence of the maximum value and/or of the minimum value can be determined as a criterion or criteria. Furthermore, alternatively or in addition to the plausibility check, an asymmetry between the distance of the maximum value from a reference value and the distance of the minimum value from the reference value can be determined as a criterion. In addition, it is possible to use the plausibility check to compare the difference value with a minimum difference value and/or with a maximum difference value, and to use it as a criterion. For the plausibility check, one of the named criteria, two of the named criteria, three of the named criteria, four of the named criteria, or all five of the named criteria, as well as alternative or additional further criteria, may be used.

In this way, a comprehensive plausibility check is possible of the signal curve of a measurement signal output by a sensor. The measurement signal can be determined in particular using a capacitive sensor that has two plate capacitors situated one after the other in the transport direction of the image carrier bearing the toner mark, the capacitors being supplied with charge voltages for the charging of the capacitors that are opposite relative to a reference potential. After the charging process, the capacitors are short-circuited, producing a charge difference. This charge difference is a measure of the difference in capacitance of the two capacitors as a result of the positioning of the toner mark in the air gap of at least one capacitor. Using such a capacitive sensor, the layer thickness, the toner quantity, and/or the surface coverage of a toner mark can easily be reliably determined.

It is particularly advantageous if at least two plausibility checks are carried out of the signal curve using two different plausibility criteria. An error counter is allocated to each plausibility check. Such an error counter is incremented when the plausibility criterion allocated to this error counter is not met. The error is decremented when the plausibility criterion has been met. The incrementing preferably takes place with a higher numerical value than the decrementing. In this way, an error signal, in particular an error message, can easily be output whenever at least one error counter exceeds a preset boundary value. Alternatively or in addition to the error message, a background compensation of the image carrier can be carried out. In this way, errors resulting from contamination and damage to the image carrier can be at least partially ignored.

Preferably, the signal curves are detected of the measurement signals of a plurality of successively produced toner marks. Using the detected signal curves, a corrected signal curve is produced. The signal curve is corrected for example using a mean value formation or median value formation. The plausibility check is then carried out for the corrected signal curve of the measurement signal.

A second aspect of the present preferred embodiments relates to a device for determining a measurement signal for detecting a property of a toner mark. The device has a sensor for detecting the signal curve of a measurement signal. In addition, the device comprises a control unit that carries out a plausibility check of the signal curve determined using the sensor.

Using such a device, it can be ensured that strongly deviating measurement values, or a signal curve that deviates strongly from the standard signal curve, or a signal curve that deviates from a possible signal curve of the measurement signal during the detection of a particular toner mark, can be determined; this signal curve is then no longer used for the controlling or regulation of the image production process.

For better understanding of the present invention, in the following reference is made to the preferred exemplary embodiments shown in the drawings, described on the basis of specific terminology. However, it is to be noted that the protective scope of the present invention is not intended to be limited thereby, because such modifications to the depicted devices and/or to the described methods, as well as additional applications of the present invention, as are indicated therein are regarded as standard current or future expert knowledge of a competent person skilled in the art. The Figures show exemplary embodiments of the present invention.

FIG. 1*a* shows a measurement arrangement 10 for detecting a toner mark 39 produced as a toner particle layer 38 using an electrographic image production process. This measurement arrangement 10 is used in an electrographic printer or copier in order to detect the inking of the print image and/or the point size of raster points inked with toner particles. Using measurement arrangement 10, the average layer thickness of a toner mark 39 present in the area of detection of this measurement arrangement 10 is detected.

Toner mark 39 has a homogenous print image having a uniform inking pattern, with a full-surface inking or with a non-full-surface inking. Using a character generator, such as an LED character generator or a laser character generator, toner layer 38 of toner mark 39 has been produced on a photoconductor band 16 charged using a charge device, for example a corotron device, as a latent raster image in the form of a charge image. This latent raster image has subsequently been developed using a developer unit (not shown) by using the toner particles provided by the developer unit to ink the latent raster image.

The developing of the latent raster image with toner particles preferably takes place using what is called a tribo jump development, in which electrically charged toner particles provided by the developer unit are transferred from the developer unit to the areas of the latent raster image that are to be inked through the force exerted by an electrical field on these particles in the direction of these areas that are to be inked. The voltage required for the production of the electrical field is also called the bias voltage. It is particularly advantageous if the developer station provides a layer of toner particles having an essentially constant layer thickness, this layer then being transferred by the bias voltage only onto the areas that are to be inked.

Between the areas of the latent raster image that are not to be inked and the developer station, the bias voltage produces another electrical field that exerts a force on the toner particles in the direction of the developer station, so that no toner particles are transferred from the developer station to the areas of photoconductor band 16 that are not to be inked. In the document "Digital Printing—Technology and Printing Technics on Océ Digital Printing Presses," $9^{th}$ edition, February 2005, ISBN 3-00-001081-5, in FIG. 8.22 on page 222 a schematic example of a tribo jump developer station is shown and briefly described.

Photoconductor band 16 is a circulating endless band that is guided using deflecting rollers (not shown). Photoconductor band 16 contains electrically conductive components that are connected in electrically conductive fashion to a reference potential 18. Toner layer 38 of the produced toner mark 39, as well as toner layers of print images, are situated on lateral surface 40 of photoconductor band 16. A first electrode 12 and a second electrode 14, realized in the exemplary embodiment as plate-type electrodes 12, 14, are situated parallel to lateral surface 40. The effective surfaces of the electrodes 12, 14 and photoconductor band 16, acting as counterelectrode, face one another, first and second electrodes 12 and 14 preferably having the same effective surface. Photoconductor band 16 is thus a counterelectrode, connected to reference potential 18, to electrodes 12, 14. First electrode 12 and the counterelectrode form a first capacitor 13, and second electrode 14 and the counterelectrode form a second capacitor 15. Given the same effective surface of electrodes 12, 14 and an identical distance of electrodes 12, 14 from the counterelectrode, first capacitor 13 and second capacitor 15 have the same capacitance, if no toner layer 38 and no toner residue, or in each case the same quantity of toner, is present between photoconductor band 16. The distance between photoconductor band 16 and electrodes 14, 16 is preset to a value in the range 0.2 mm and 10 mm. Preferably, this distance is approximately 1 mm.

A switching unit 26 is provided in order, in a first switching state, to connect electrode 12 to a voltage source 42 that is positive to reference potential 18, and to connect electrode 14 to a voltage source 44 that is negative to reference potential 18, using changeover switches 46, 48.

The contributions of the voltages provided by the voltage sources are preferably equal. For example, the positive voltage output by voltage source 42 is for example +10 V, and the negative voltage output by voltage source 44 is for example −10 V, relative to reference potential 18, for example 0 V.

In a second switching state, switching unit 26 breaks the connections to voltage sources 42, 44 using changeover switches 46, 48, short-circuits the two electrodes 12, 14, and in this way creates a connection to evaluation unit 24. In this way, the charge difference of capacitors 13, 15 is determined, and is supplied to evaluation unit 24. Through the changeover to the second switching state, there takes place a scanning of the measurement value produced by the charge difference. A clock signal 34 of a clock 32 is supplied to switching unit 26; this signal is preferably a rectangular signal having a constant pulse-to-no-current ratio. The clock frequency of clock signal 34, and thus the switching frequency of switching unit 26 for switching the two switching states, or of changeover switches 46, 48, is preferably in the range between 300 Hz and 1 MHz.

Clock 32 is in particular a component of the control unit for evaluating the sensor signal output by measurement arrangement 10, clock signal 34 causing in the switching unit a change in the switching state of changeover switches 46, 48. The switching over of the capacitors as a result of the switching states is also called switched capacitor technique. Further details of the design, and additional embodiments of measurement arrangement 10, can be learned from document DE 101 51 703 A1, as well as from the parallel U.S. Pat. No. 6,771,913 B2, whose content is hereby incorporated into the present description by reference.

Evaluation unit 24 can for example have a filter and a downstream amplifier. A measurement signal produced by evaluation unit 24 is supplied to a control unit (not shown) for further processing. If, as already mentioned, a filter is used in evaluation unit 24 for the evaluation, the filter type, as well as the required filter parameters of the filter, can be preset as a function of the switching frequency and the scanning frequency resulting therefrom.

If the toner particle layer 38 of toner mark 39 is transported through the air gaps of electrodes 12, 16 and 14, 16 onto photoconductor band 16 in the direction of arrow P1, the difference in capacitance between the two capacitors 13, 15 is determined at each scanning time, or at each changeover time to the second operating state. The capacitances of capacitors 13, 15, which are equal when there are no toner marks in the area of detection of measurement arrangement 10, change when toner particles are present in the area between the respective electrode 12, 14 and the counterelectrode, because the toner particles have a different dielectric constant than does the air that is otherwise exclusively present between electrodes 12/16, 14/16.

From the change in the capacitance of at least one of capacitors 13, 15, it is possible to determine the layer thickness of the toner particle layer that would be present on the effective surface of the respective capacitor 13, 15 given a uniform distribution of the toner particles present in the respective capacitor 13, 15. In this way, the average layer thickness is determined of the toner particles present in the area of detection of the respective capacitor 13, 15, because a toner mark 39 which covers half the effective surface of a capacitor 13, 15 and has a first layer thickness cannot be distinguished from a second toner mark 39 that covers the entire effective surface of capacitor 13, 15 and has half the layer thickness of the first layer thickness.

However, it is also possible to determine the exact layer thickness curve of a toner mark in the transport direction of photoconductor band 16 on the basis of the capacitance curve, given correspondingly expensive evaluation and a sufficient number of scannings relating to the speed of the transport of photoconductor band 16 in the direction of arrow P1.

The change in capacitance of capacitors 13, 15 resulting from the toner particles of toner layer 38 present on photoconductor band 16 in the area of capacitors 13, 15 results from the change in the dielectric, i.e., from the change in the coated dielectric of the respective capacitor 13, 15 during the transporting through of toner layer 38 between the respective electrode 12, 14 and the counterelectrode of the respective capacitor 13, 15.

The charge difference produced by the short-circuit of electrodes 12, 14 in the second switching state as a function of the capacitances of capacitors 13, 15 at the time of scanning is further processed using evaluation circuit 24, and is preferably supplied to the control unit. According to the present preferred embodiments, given a known layer thickness the control unit can also determine the surface coverage of the respective toner mark 39 if the print image of the respective toner mark 39 is not completely inked with toner particles. In particular given toner marks 39 having a plurality of strip-shaped or line-shaped print image areas inked with toner particles and situated alongside one another, using a capacitor 13, 15 and given a constant known layer thickness the surface inked with toner particles and/or the surface not inked with toner particles of toner mark 39 can be determined in the area of the respective capacitor 13, 15. Given toner marks inked over the complete surface with toner particles, the layer thickness of the toner particle layer, and thereby the optical density of the toner mark, can be determined. In the same way, the inked surface of toner mark 39 can be determined if toner mark 39 has, in addition or alternatively, punctiform inked areas. These punctiform inked areas can be both individual pixels and also areas composed of a plurality of pixels, known as superpixels.

It is advantageous to supply to arrangement 10 a toner mark inked over its entire surface and a toner mark not inked over its entire surface in an arbitrary sequence, whose areas to be inked are each inked with the same layer thickness, whereby the ratio of the toner quantity of the toner mark not inked over its entire surface can be determined as a function of the toner quantity of the toner mark inked over its entire surface. In this way, the relative inking, or the percent value of the surface of the partly inked toner mark, can be determined relative to the toner mark inked over its entire surface.

Figure 1B:
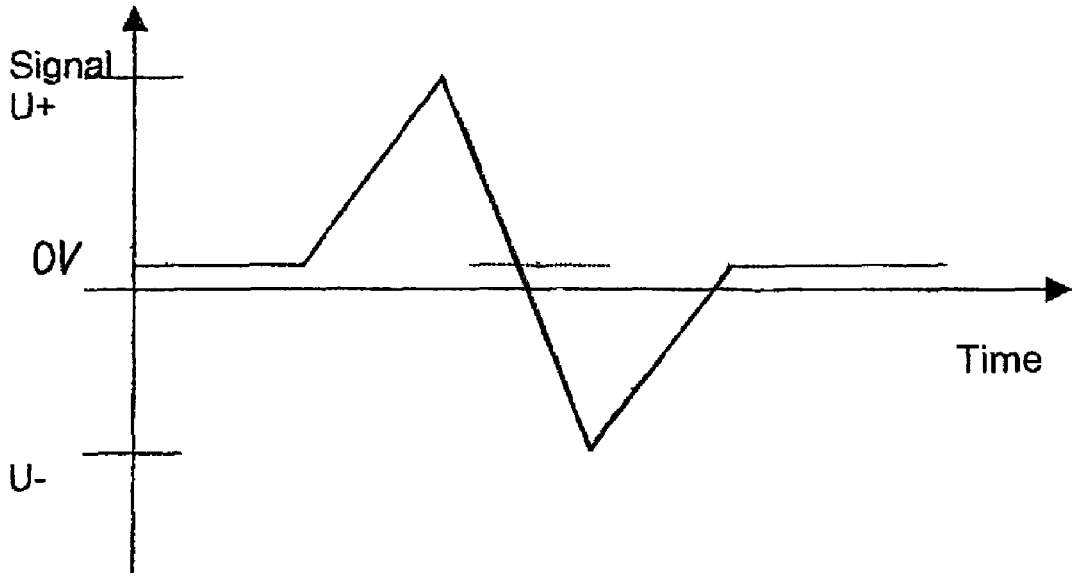
FIG. 1*b* shows a voltage-time diagram showing the curve in principle of a measurement signal produced by the device according to FIG. 1*a* during the guiding through of a toner mark.

FIG. 1*b* shows a time-voltage diagram showing the signal curve in principle of a measurement signal output by the measurement arrangement according to FIG. 1*a*. For simplification, in the time-voltage diagram according to FIG. 1*b* a continuous signal curve is shown. However, the actual signal curve is composed from a multiplicity of scanned values. The scanning rate for the determination of these scanned values is determined by clock signal 34 output by clock 32. The signal curve is scanned, using evaluation arrangement 24, when toner mark 39 passes through capacitors 13, 15, if photoconductor band 16 is led between electrodes 12, 14 with a constant speed, for example in the range from 0.2 to 2 meters per second, and photoconductor band 16 is led through capacitors 13, 15.

The dielectric constant of toner is greater than the dielectric constant of air. Therefore, the capacitance of capacitors 13, 15 changes when toner mark 39 is led through these capacitors 13, 15. Using photoconductor band 16, toner layer 38 of toner mark 39 is transported into first capacitor 13. This increases the capacitance of first capacitor 13. The capacitance of first capacitor 13 increases until toner layer 38 of toner mark 39 covers the largest possible effective surface of first capacitor 13. As a result, the signal shown in FIG. 1*b* rises, with increasing capacitance of first capacitor 13 from 0 V up to a maximum U+. Due to the continuous drive of photoconductor band 16, toner layer 38 of toner mark 39 is further transported into second capacitor 15, and is simultaneously transported out of first capacitor 13. As a result, the capacitance of second capacitor 15 increases to the same extent that the capacitance of first capacitor 13 decreases. In this way, the negative rise of the output signal of evaluation arrangement 24 is approximately twice as large as would be the case if toner layer 38 of toner mark 39 were simply transported out of first capacitor 13, or if toner layer 38 of toner mark 39 were simply transported into second capacitor 15.

If toner layer 38 has been transported completely out of first capacitor 13, and this toner layer 38 covers the largest possible effective surface of second capacitor 15, evaluation arrangement 24 outputs a voltage signal U−. Subsequently, toner layer 38 is transported out of second capacitor 15, causing the voltage signal output by evaluation arrangement 24 to rise continuously from the value U− to 0. This rise takes place up until the time at which toner layer 38 has been transported completely out of second capacitor 15.

Given toner marks that are not inked over their entire surface, which have for example a plurality of strip-shaped inked areas situated alongside one another, using measurement arrangement 10 the average layer thickness of toner mark 39 can be determined that would be produced given a uniform distribution of the toner particle quantity used to ink the toner image that is not inked over its entire surface. Using measurement arrangement 10, at least with a greater expense a stepwise change in capacitance is possible as a result of the inked and non-inked areas of a toner mark, if strip-shaped inked areas of toner mark 39 are oriented transverse to transport direction P1 of the photoconductor band. Alternatively, or in addition, the toner mark not inked over its entire surface can comprise areas that are inked in a punctiform manner, made up of a pixel, or in which a punctiform inked area comprises a plurality of pixels, forming what is called a superpixel. The superpixel comprises for example 2×2, 2×3, or 4×4 pixels.

The average inking of a toner mark, or a measurement signal that corresponds to the average layer thickness of a toner mark not inked over its entire surface, can be easily determined using measurement arrangement 10. If in addition the layer thickness is known with which the toner image not inked over its entire surface is inked, the surface coverage of this toner mark not inked over its entire surface can easily be determined on the basis of the determined average layer thickness of the toner mark not inked over its entire surface.

For this purpose, the layer thickness can be determined, in particular measured, in various ways. Preferably, a toner mark inked over its entire surface is detected using the arrangement according to FIG. 1*a*, and the difference in the change in the capacitances of capacitors 13, 15 resulting from the toner mark inked over its entire surface and from the toner mark not inked over its entire surface indicates the surface coverage of the toner mark not inked over its entire surface. This is possible because the inked areas of the toner mark inked over its entire surface and of the toner mark not inked over its entire surface have the same layer thickness of the toner particle layer used for the inking.

Figure 2:
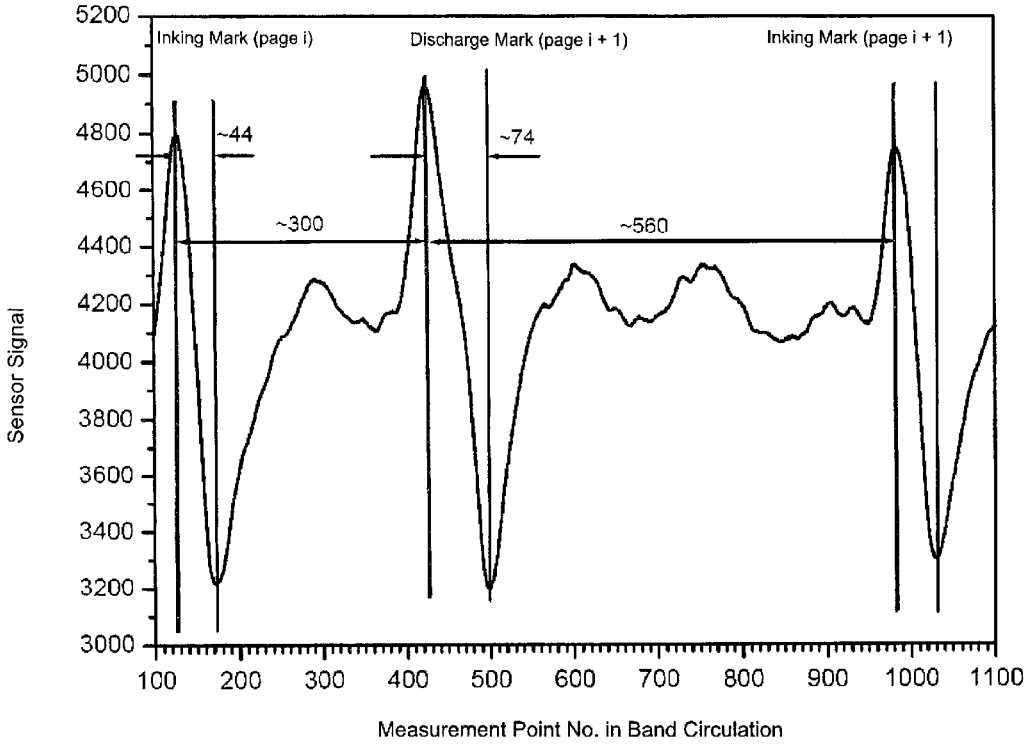
FIG. 2 shows a diagram with the signal curve of the sensor signal over 1000 scanning points of a toner mark produced by a first printing device.

FIG. 2 shows an actual signal curve of the sensor signal of the measurement arrangement according to FIG. 1*a*, over a part of a print page i that is to be produced and a second print page i+1 that has been determined using a total of 1000 scanning points. On photoconductor band 16, a first toner mark, designated the discharge mark, and a second toner mark, designated the inking mark, are produced for each print page that is to be produced. The marks inked with toner are preferably produced in areas on photoconductor band 16 that are not transferred onto a carrier material that is to be imprinted, in particular not onto individual sheets or onto a web-shaped recording carrier. Alternatively, the toner marks can be produced and scanned in an operating state in which no further print images are produced.

Using the scanning of the sensor signal described in connection with FIG. 1*a*, a plurality of measurement points are detected in succession, of which in FIG. 2 the signal values are shown, as examples, that were determined for the measurement points 100 to 110. The maximum value and the minimum value of the change in the sensor signal brought about by the inking mark of page i are approximately 44 measurement points distant from one another. In addition, the maximum and minimum of the signal change brought about by the discharge mark of page i+1 are approximately 74 measurement points distant from one another. The maximum and the minimum of the signal curve, brought about by the inking mark of page i+1, of the measurement arrangement according to FIG. 1*a* are approximately 45 measurement points distant from one another. Due to the differing distances of the maximum and minimum values of the signal curve brought about by the inking marks and of the signal curve brought about by the discharge marks, it can easily be determined whether the maximum and minimum values are those of an inking mark or of the discharge mark. Thus, confusions between these two toner marks can easily be avoided. Such confusions could otherwise possibly have the result that the image production process would be influenced on the basis of incorrect measurement values. In particular, an inking controlling, or some other controlling or regulation required for the image production process, would not take place, as desired, on the basis of the signal curve of the inking mark, but rather on the basis of other values, such as the discharge mark, and would therefore be incorrect.

In addition, a measurement point distance between the discharge mark and the inking mark is specified by the positioning of the discharge marks and inking marks relative to one another. In particular, in this way what are known as measurement windows can easily be defined in which the maximum value and the minimum value must occur in the overall signal curve. Here, it is possible to detect and/or analyze and evaluate only the signal curve in the preset measurement window.

Figure 3:
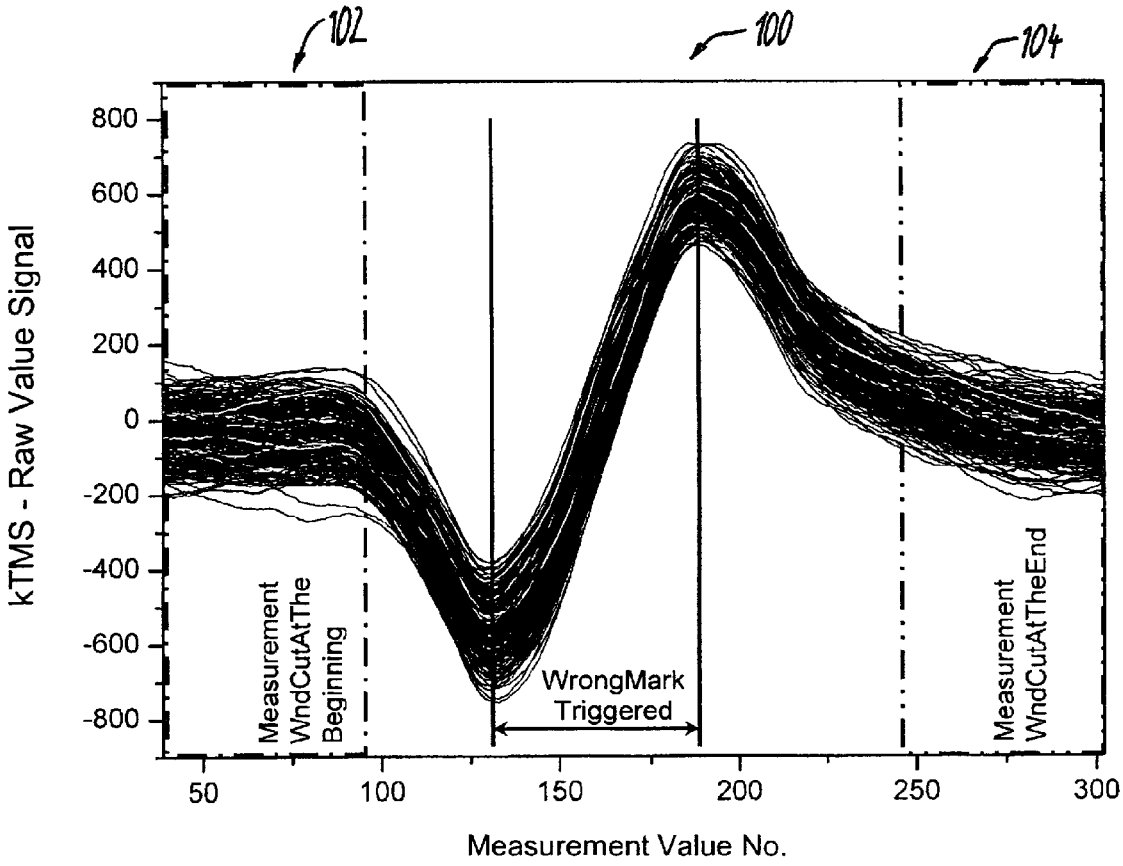
FIG. 3 shows the respectively scanned signal curves of the sensor signal given a multiplicity of toner marks produced one after the other by a second printing device.

FIG. 3 shows a diagram of the actual signal curves over approximately 260 measurement points of a plurality of inking marks produced and scanned one after the other. Each of these signal curves was detected in the time window shown in FIG. 3. According to FIG. 3, the measurement window shown in FIG. 3 comprises areas 100, 102, 104. Here it is checked whether the respective signal curve has occurred in a time region 102 at the beginning of the measurement window and/or in a region 104 at the end of the measurement window. In this way, the position of each toner mark inside the measurement window is checked.

If, for example, the minimum value is situated in area 102, or the maximum value is situated in area 104, it is not ensured that the overall signal curve produced by the toner mark is present in area 100 used for the evaluation. The measurement window, composed of the areas 100, 102, 104, has an overall size of approximately 260 measurement points, which define the time period of the measurement window. The signal curve influenced immediately by the inking mark comprises approximately 150 measurement points. The signal curve influenced by a discharge mark comprises approximately 200 measurement points.

The distance between the maximum and minimum of the inking marks is approximately 45 measurement points, and the distance from the maximum to the minimum of discharge marks is approximately 75 measurement points. Within a print page having a side length of 12 inches, the distance from the maximum of the discharge mark to the maximum of the inking mark is approximately 300 measurement points, and the distance between the maximum of the inking mark and the maximum of the discharge mark is approximately 560 measurement points.

It is to be noted that the sequence of maximum and minimum in the signal curve can differ depending on the design of the printing device and the measurement arrangement. For the evaluation and plausibility check, each pair of extreme values brought about by the toner marks in the signal curve of the measurement arrangement is therefore decisive. Differing from the diagrams in FIGS. 1*b* and 2, in FIG. 3 the signal curve of another printing device has been detected using measurement arrangement 10, such that when the inking mark is supplied a minimum is first produced as an extreme value and a maximum is subsequently produced as an extreme value.

On the basis of the determined signal curve, it is checked whether a minimum or maximum in the signal curve brought about by the toner mark is situated in area 102. It is also checked whether a minimum or maximum brought about by the toner mark in the signal curve occurs in area 104. In addition, it is checked whether the difference between the maximum value and the minimum value comprises at least 500 measurement units. In the case of the only partly inked discharge marks, i.e. in the case of toner marks not inked over their entire surface, the minimum difference to be exceeded of 500 measurement units may also be selected to be smaller. In addition, it is checked whether the extreme values (minimum, maximum) are situated symmetrically to a defined null line. The tolerance for a deviating asymmetry here is ±75 measurement units. The maintenance of the distance between the two extreme values (minimum, maximum) is indicated by the status variable "WrongMarkTriggered"; the distance is permitted to be a maximum of 60 measurement points and a minimum of 30 measurement points. The first extreme value (in FIG. 3: minimum) should lie at least 60 measurement points after the beginning of the measurement window, and thus not in area 102. The second extreme value (in FIG. 3: maximum) should lie at least 60 measurement points before the end of the measurement window, and thus not in area 104. The presence of an extreme value in area 102 is indicated by the status variable "WndCutAtTheBeginning" and in area 104 by the status variable "WndCutAtTheEnd".

The minimum distance between two toner marks is at least 300 measurement points. Within an inking mark, the maximum distance between the minimum and maximum is 75 measurement points. In this way, theoretically an extreme value of the previous discharge mark could lie within the measurement window of the inking mark currently to be considered. However, due to the defining of the measurement window and of the additional plausibility criteria, there takes place a check by which such a misinterpretation of signal curves is avoided. In this way, it is ensured that in fact the signal curve of a single toner mark (inking mark or discharge mark) is regarded and evaluated, and subsequently the extreme values corresponding to a toner mark are determined and used for further processing.

The inking mark is a toner mark for the determination of an actual value for an inking controlling, with which in particular the toner quantity that is to be conveyed into the developer station is controlled corresponding to the determined inking. This inking mark is preferably an inking mark inked over its entire surface. In addition, a second toner mark inked over its entire surface is produced, as a discharge mark, at a distance from the first toner mark. Using this discharge mark, the discharge potential of raster points that are to be inked with toner particles is controlled to a prespecified target value, and using this discharge mark the discharge potential is set via the light energy outputted by the character generator for the discharging of a raster point that is to be inked.

The toner particles for inking are preferably provided, using an applicator element, by the developer station as a toner particle layer having a preset, preferably regulated, layer thickness. Between the toner particle layer and the lateral surface of the image carrier, an air gap is preferably provided, the toner particles of the toner layer being transferred past this air gap onto the image carrier using what is called a bias voltage. The applicator element is supplied with the bias voltage, and produces, on the basis of the potential difference from the discharge potential, an electrical field that exerts on the provided toner particles a force from the developer station toward the areas of an image carrier that are to be inked.

The following are preferably used as plausibility criteria for checking the scanned signal curve:

1. The minimum difference between the maximum and minimum (minimum signal stroke)

2. The difference from the maximum to a reference value and from the minimum to the reference value (symmetry of minimum and maximum to the reference value)

3. The temporal distance between the maximum and minimum

4. The temporal distance from the extreme values to the edges of the measurement window.

The first criterion ensures that the signal curve has actually been brought about by a toner mark. The second criterion ensures that the determined maximum value and minimum value are also the absolute maximum and the absolute minimum of the signal curve brought about by the toner mark under consideration, because an asymmetry of the minimum value and the maximum value to a reference point would permit an inference to extreme values of different toner marks. The third criterion is used to distinguish inking marks and discharge marks, and the fourth criterion ensures that the entire toner mark under consideration lies within the measurement window. For this algorithm, preferably a signal curve averaged over a plurality of similar toner marks (a plurality of discharge marks or a plurality of inking marks) should be determined (for example over five similar toner marks), in order to exclude the influence of coarse signal disturbances. Alternatively, a median value curve can be determined over the signal curves of a plurality of toner marks, or a smoothed signal curve can be produced using a corresponding curve function (digital compensation curve).

Figure 4:
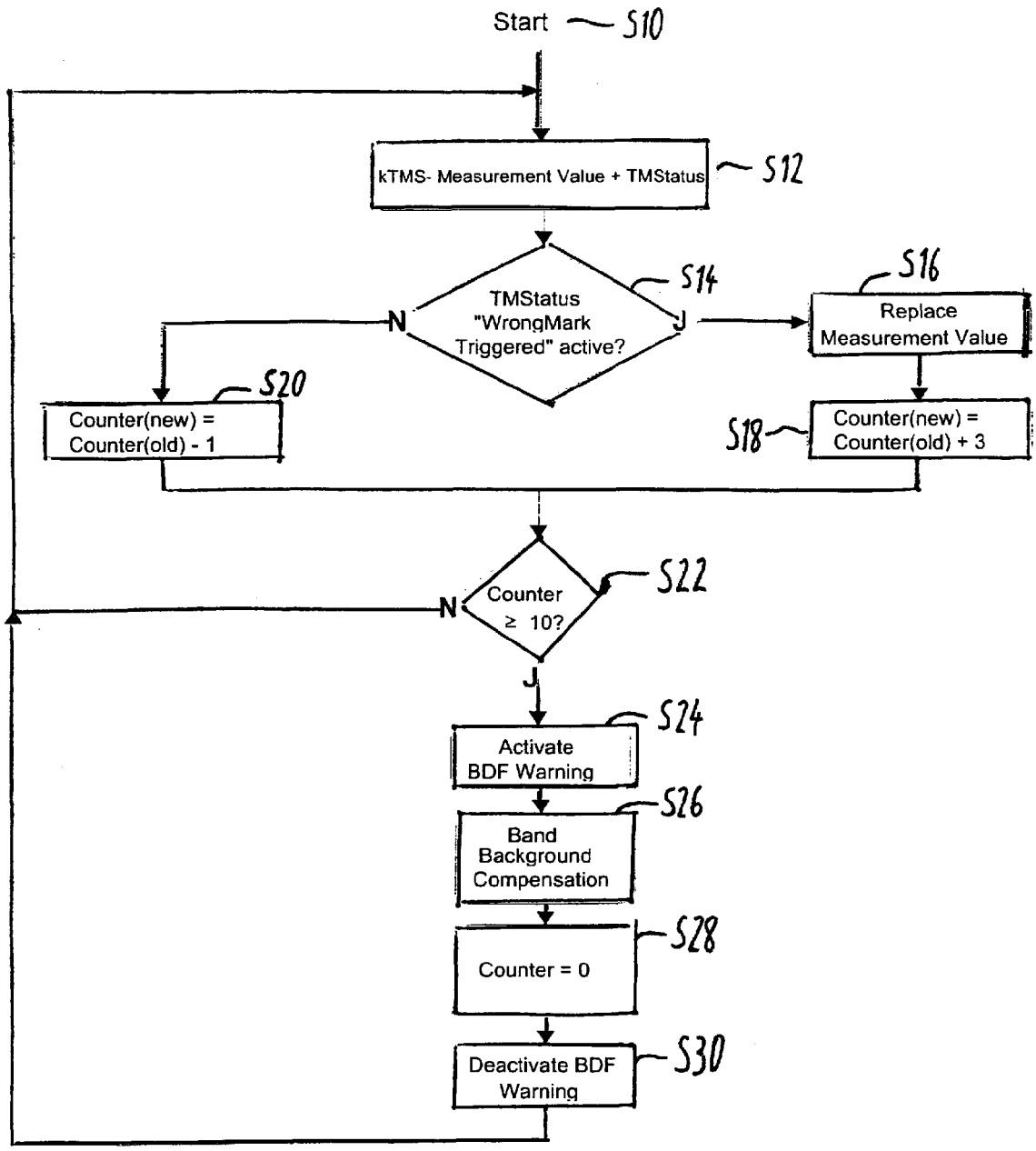
FIG. 4 shows a first sequence plan for checking a first plausibility criterion.

FIG. 4 shows a sequence plan for the plausibility check of the temporal distance between the two extreme values of a signal curve produced by a toner mark. The sequence starts at step S10. Subsequently, in step S12 the signal curve produced on the basis of the toner mark supplied to the toner mark sensor is analyzed, and the status variable "WrongMarkTriggered" is determined. The status variable indicates whether the minimum permissible distance between the two extreme values and/or the maximum permissible distance between the two extreme values has been maintained or not. Subsequently, in step S14 it is checked whether the status variable "WrongMarkTriggered" indicates that the determined extreme values have a too-large or too-small temporal distance from one another. If this is the case, subsequently in step S16 a previously determined measurement value or a preset value is used as a further measurement value to be processed, in which the currently determined measurement value is replaced by the previously determined valid measurement value or the preset value. Subsequently, in step S18 an error counter is increased by the value 3.

If it is determined in step S14 that the status variable indicates that the temporal distance between the extreme values is within the permissible range, in step S20 the counter value of the error counter is reduced by the value 1. Subsequently, or after the counter in step S18 has been increased by the value 3, in step S22 it is checked whether the error counter is greater than or equal to the preset boundary value of 10. If this is not the case, the sequence is continued in step S12 by detecting the measurement value curve of a further toner mark, as well as its toner mark status.

However, if in step S22 it is determined that the permissible boundary value of 10 has been reached or exceeded, subsequently in step S24 an error message is output via an operating panel of the printer or copier system. Subsequently, in step S26 a procedure is started for the band background compensation, and subsequently the error counter is set to zero in step S26. In addition, the warning output via the operating panel is deactivated in step S30. Subsequently, the sequence is continued in step S12 for a further toner mark.

Figure 5:
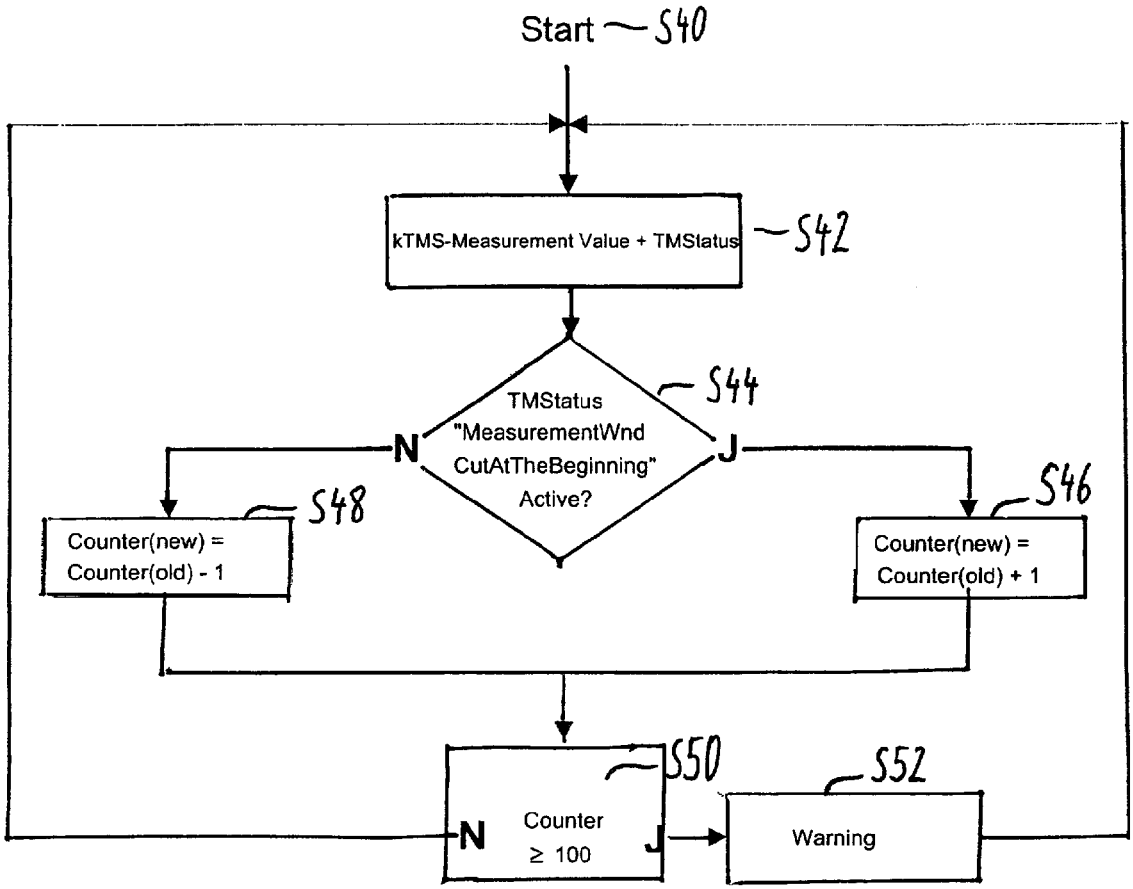
FIG. 5 shows a sequence plan for checking a second plausibility criterion.

In FIG. 5, a sequence plan is determined for the plausibility check of the distance of the first extreme value (in FIG. 3: minimum) to the beginning of the measurement window. The sequence is started in step S40. In step S42, in the same way as in step S12 according to FIG. 5 the signal curve, produced by the toner mark, of the capacitive toner mark sensor is determined and analyzed. On the basis of the signal curve, the status variable "MeasurementWndCutAtTheBeginning" is determined and activated if warranted; for example, this status variable is set to the value 1 if an extreme value (minimum) has already occurred in operating area 102. In step S44 it is then checked whether the status variable "MeasurementWndCutAtTheBeginning" is activated, i.e. has the value 1. If this is the case, subsequently in step S46 the counter of the error counter allocated to this error is increased by the value 1. If it is determined in step S44 that the first extreme value does not lie within operating area 102, the variable "MeasurementWndCutAtTheBeginning" is not activated, and the sequence is continued in step S48 by reducing the counter value of the error counter by 1. Subsequently, in step S50 it is checked whether the error counter has reached or exceeded a boundary value of 100. If this is the case, in step S52 a warning is output, preferably via the operating panel of the printer or copier system. The sequence is subsequently continued in step S42 for a further toner mark. If it is determined in step S50 that the boundary value of the error counter has not been exceeded, the sequence is likewise continued in step S42.

Figure 6:
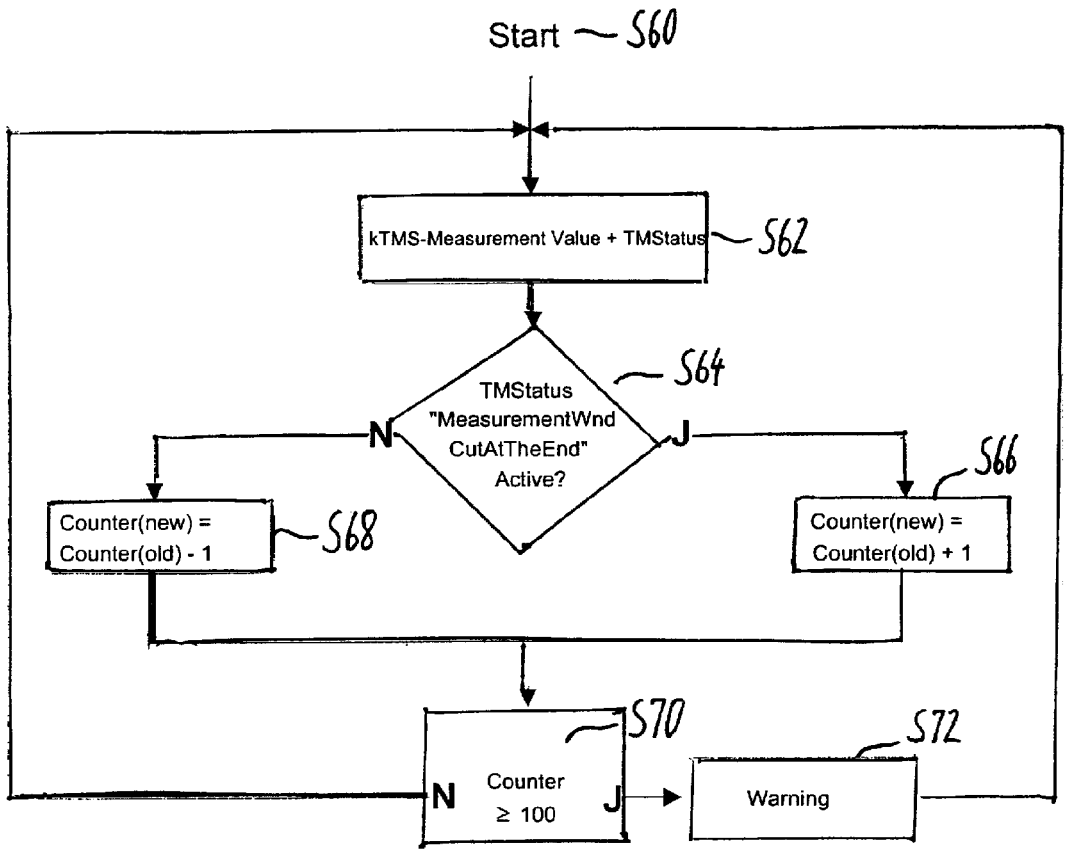
FIG. 6 shows a sequence plan for determining a third plausibility criterion.

FIG. 6 shows a sequence plan in which it is checked whether the second extreme value (in FIG. 3: maximum) occurs in operating area 104 at the end of the measurement window. The sequence is started in step S60. Subsequently, in step S62 the signal curve, brought about by the toner mark, of the capacitive toner mark sensor, as well as the status of this toner mark, is determined and analyzed. Based on the signal curve, the status variable "MeasurementWndCutAtTheEnd" is determined and set. For example, the status variable "MeasurementWndCutAtTheEnd" is activated if an extreme value occurs in area 104. Subsequently, in step S64 it is checked using the status variable "MeasurementWndCutAtTheEnd" whether an extreme value of the signal curve caused by the toner mark has occurred in area 104. If this is the case, subsequently in step S66 the counter value of an error counter is increased by 1. If this is not the case, in step S68 the counter value of the error counter is reduced by the value 1. After step S66, or after step S68, in step S70 it is checked whether the counter value has reached or exceeded the boundary value 100. If this is the case, a warning is output, preferably via an operating panel of the printer or copier, and the sequence continues in step S62 for a further toner mark. If in step S70 it is determined that the boundary value has not been exceeded, the sequence is likewise continued in step S62.

The error counters are designed such that they cannot assume negative values. The activation of the status variables "WrongMarkTriggered" can be caused by defects in the photoconductor or by deposits. Defects in the photoconductor can be determined by a band background compensation, and their effects on the evaluation of the toner mark can be taken into account (screened out). If the status value "WrongMarkTriggered" is activated, it is to be assumed that the determined signal curve cannot be used as a basis for controlling the image production process, or for the controlling required for a stable image production process, so that the last measurement value found to be valid is used as a further measurement value to be processed and is output for further output. Areas 102, 104 are protected areas at the beginning or end of the measurement window. If the status variable "MeasurementWndCutAtTheBeginning" and/or the status variable "MeasurementWndCutAtTheEnd" are activated together with the status variable "WrongMarkTriggered", this is an indication of defects in the photoconductor, as well as toner deposits. If the status variable "MeasurementWndCutAtTheBeginning" or the status variable "MeasurementWndCutAtTheEnd" is activated, this indicates timing problems, which can be caused in particular by an incorrectly defined trigger time, the construction of the mark band, or band slippage.

The present preferred embodiment can advantageously be used in electrographic printer or copier devices whose recording method for image production is based in particular on the electrophotographic, magnetographic, or ionographic recording principle. In addition, the printer or copier devices can use a recording method for image production in which an image recording carrier is directly or indirectly controlled electrically in pixel-by-pixel fashion. However, the present preferred embodiment is not limited to such an electrographic printer or copier devices.

Although in the drawings and in the foregoing description preferred exemplary embodiments have been indicated and described in detail, this is to be understood as purely exemplary, and not as limiting the present invention. It is to be noted that only the preferred exemplary embodiments have been presented and described, and that all modifications and changes lying within the scope of protection of the present invention, currently and in the future, are intended to be protected.

The invention claimed is:

1. A method for processing a measurement signal for detecting a property of a toner mark comprising the steps of:

producing the toner mark using an image producing device;

detecting the toner mark using a measurement device;

outputting a measurement signal by the measurement device, a signal curve of the measurement signal being determined;

providing a temporal measurement window for detecting a property of the toner mark, said temporal measurement window having a beginning and an end; and carrying out a plausibility check of the determined signal curve, wherein a maximum value and a minimum value of the signal curve are determined, a first difference value between the maximum value and the minimum value is determined and is output for further processing, a first temporal distance is determined between an occurrence of the maximum value and an occurrence of the minimum value, a second temporal distance is determined between at least one of said beginning and end of said measurement window and said occurrence of at least one of the maximum value and the minimum value, and a second difference value is determined between a first distance of said maximum value from a reference value and a second distance of said minimum value from said reference value, and said second determined difference value is compared to at least one of a defined minimum difference value and a defined maximum difference value.

2. The method of claim 1 wherein using the plausibility check it is determined whether at least one of the determined measurement value curve, the determined maximum value, the determined minimum value, and the difference value are characteristic for the produced toner mark.

3. The method of claim 1 wherein the measurement signal is determined using a capacitive sensor of the measurement device that has two capacitors situated one after the other in a direction of transport of an image carrier bearing the toner mark, the capacitors being supplied with charge voltages for charging of the capacitors that are opposite relative to a reference potential, and the capacitors are short-circuited after a charge operation, thus producing a charge difference that is a measure of a difference in capacitance of the two capacitors as a result of a positioning of the toner mark in an air gap of at least one of the capacitors.

4. The method of claim 1 wherein at least two plausibility checks are carried out on the signal curve using two plausibility criteria that are different from each other, to each of the plausibility criteria an error counter is allocated, the error counter being incremented if the plausibility criterion is not met, and decremented if the plausibility criterion is met.

5. The method of claim 4 wherein the numerical value of each error counter is compared to a respective preset boundary value, and when the preset boundary value is at least one of reached and exceeded, at least one of an error message is output and a background compensation of an image carrier is carried out.

6. The method of claim 1 wherein signal curves of measurement signals of a plurality of toner marks produced one after the other are detected, and by the detected signal curves a corrected signal curve is produced, the plausibility check being carried out for the corrected signal curve.

7. A system for determining a measurement signal for detecting a property of a toner mark, comprising:

an image producing device for producing the toner mark;

a measurement device that detects the toner mark and that outputs a measurement signal; and a control unit that determines a signal curve of the measurement signal and that carries out a plausibility check of the signal curve, the control unit providing a temporal measurement window for detecting a property of the toner mark, said temporal measurement window having a beginning and an end, and wherein carrying out said plausibility check of the determined signal curve, a maximum value and a minimum value of the signal curve are determined, a first difference value between the maximum value and the minimum value is determined and is output for further processing, a first temporal distance is determined between an occurrence of the maximum value and an occurrence of the minimum value, a second temporal distance is determined between at least one of said beginning and end of said measurement window and said occurrence of at least one of the maximum value and the minimum value, and a second difference value is determined between a first distance of said maximum value from a reference value and a second distance of said minimum value from said reference value, and said second determined difference value is compared to at least one of a defined minimum difference value and a defined maximum difference value.

* * * * *